United States Patent [19]

Hakun et al.

[11] Patent Number: 4,653,642

[45] Date of Patent: Mar. 31, 1987

[54] MASK DISPLAY PACKAGE

[75] Inventors: Robert Hakun, Royersford; Clarence W. Huling, Collegeville, both of Pa.

[73] Assignee: Collegeville Flag & Manufacturing Co., Collegeville, Pa.

[21] Appl. No.: 776,687

[22] Filed: Sep. 16, 1985

[51] Int. Cl.[4] ..... B65D 25/32; B65D 25/54

[52] U.S. Cl. ..... 206/486; 206/471; 206/457; 206/458; 206/45.31; 206/45.33; 206/461

[58] Field of Search ..... 206/486, 471, 483, 461, 206/457, 292, 458, 451.33, 575, 470, 44.11, 45.31

[56] References Cited

U.S. PATENT DOCUMENTS

| | | | |
|---|---|---|---|
| 1,907,937 | 5/1933 | Lerkoff | 206/458 |
| 2,628,169 | 2/1953 | Berthold, Jr. | 206/457 |
| 3,029,538 | 4/1962 | Soltz | 206/486 |
| 3,190,435 | 6/1965 | Schlanger . | |
| 3,659,704 | 5/1972 | Collura et al. | 286/45.31 |
| 3,696,918 | 10/1972 | Lerner | 206/45.31 |
| 4,438,846 | 3/1984 | Stylianou | 256/45.31 |
| 4,453,629 | 6/1984 | Goldberg . | |
| 4,485,921 | 12/1984 | Geller . | |

*Primary Examiner*—William Price
*Assistant Examiner*—Brenda J. Ehrhardt
*Attorney, Agent, or Firm*—King & Schickli

[57] ABSTRACT

A mask display package includes inner and outer shell members for protecting the face covering portion of the mask and maintaining that portion sanitary. An outer frame member holds the shell members and mask together. The frame member includes front and back panels connected by a fold line and providing a reinforced header. An access opening is provided in the back panel to allow inspection of the back of the head portion of the mask. Additionally, a neck portion of the mask is extended through a passage along a bottom portion of the frame to the outside of the package for inspection. A serrated edge forming a portion of the access opening serves to retain the neck portion in the tucked position.

15 Claims, 6 Drawing Figures

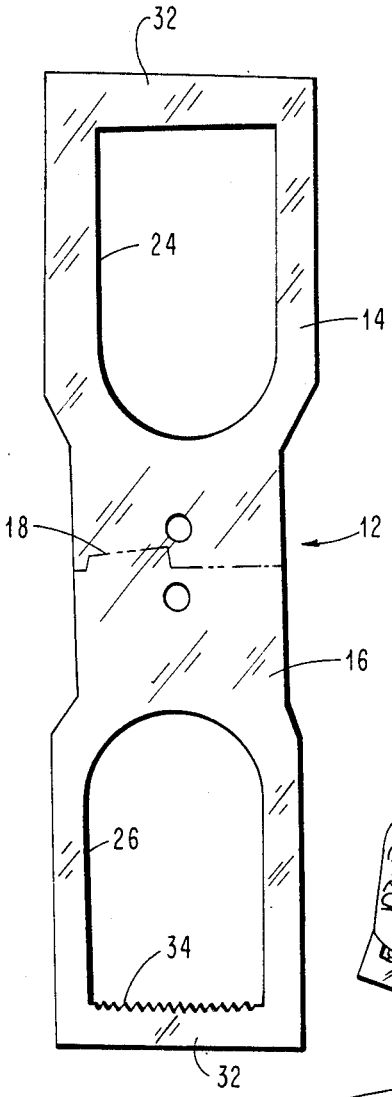
Fig 1
Fig 2
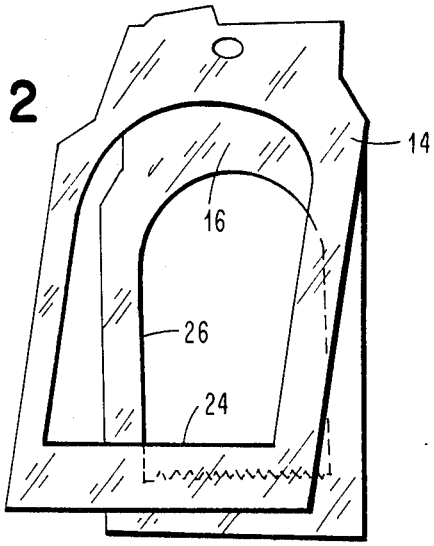
Fig 3
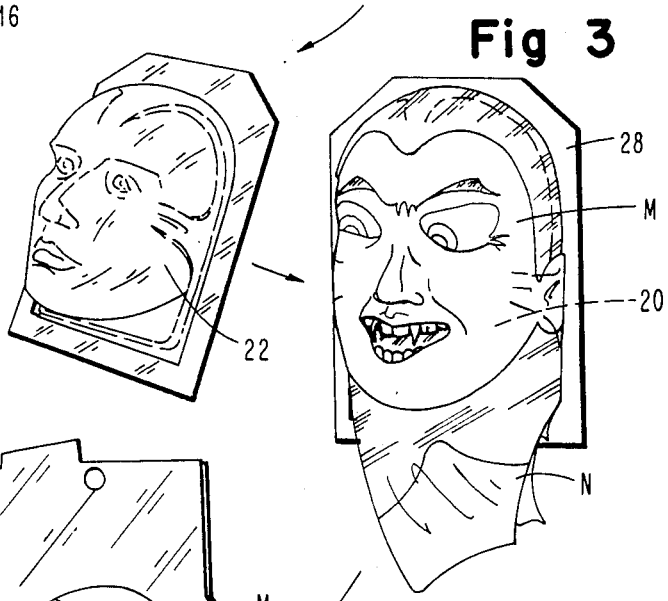
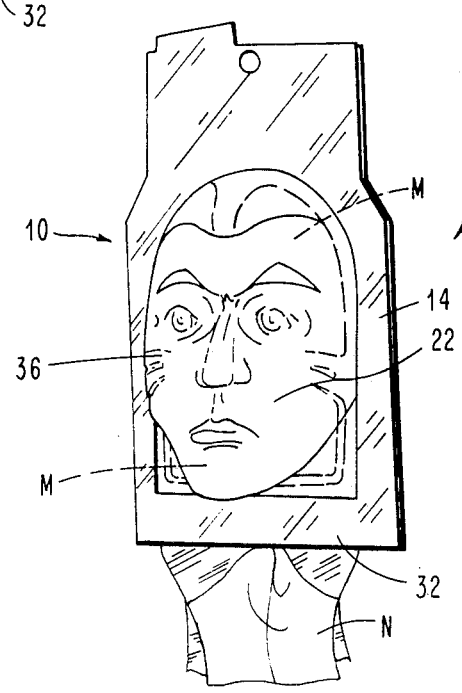
Fig 4

MASK DISPLAY PACKAGE

BACKGROUND OF THE INVENTION

The present invention relates generally to the packaging field and, more particularly, to a display package for a full head mask exposing a portion of the mask for customer examination while maintaining the face covering portion of the mask relatively sanitary.

In the past it has been common practice to package Halloween and costume masks in bulk cartons for delivery to the retailer. At the point of sale, the masks are sometimes all mixed together on a table or rack creating not only a very unsanitary condition, but also leading to damage of the masks, and generally a negative impression on the customer. In order to alleviate this problem, package designers moved to such solutions as sealed plastic bags and cardboard boxes with clear plastic viewing windows.

While these prior art containers surround and adequately protect the masks from damage, particularly during shipping, it is difficult for the customer to examine the mask material. In addition, sales encouragement to the purchaser is still lacking since the bags or boxes still end up piled on top of each other and shuffled about. This disadvantage is compounded by the relatively high initial cost and the fact that potential purchasers are likely to open the containers to feel the masks so that damage and soiling of the mask and packages results, leaving the retailer with unsaleable stock.

In an effort to alleviate this shortcoming, U.S. Pat. No. 4,485,921 to Geller provides a mask package wherein a mask is mounted to a supporting shell. The shell is provided with a header having a hole for hanging on horizontal display rods. This overcomes the basic problem of poor display and some of the potential physical damage. However, the front of the mask is left completely open and exposed to purchasers and other potentially harmful ambient conditions. The exposure of the front of the mask is particularly harmful since foreign matter, such as germs or dust, can be directly ingested through the mouth or nose, or through the fluid in the eyes, when the unsuspecting purchaser puts it on. This hygiene problem should not be belittled as many masks are not readily cleanable and children will want to wear a new mask immediately without any thought to this potentially dangerous problem and before anything can be done by a parent to correct the situation.

SUMMARY OF THE INVENTION

Accordingly, it is a primary object of the present invention to provide an improved full head mask display package overcoming the above-described limitations and disadvantages of the prior art.

Another more specific object of the present invention is to provide an improved display package for full head masks including a forwardly projecting shell contoured in the shape of a face that allows realistic display of the mask and nesting of masks one in another for stacking and display purposes.

Another object of the present invention is to provide an improved display package for a full head mask allowing the consumer to actually touch and examine the mask material without opening the package, but while still protecting the face covering portion of the mask from germs, soil and damage.

Still another object of the present invention is to provide a full head mask display package that maintains the face covering portion of the mask relatively sanitary while providing an exposed section of the mask for consumer examination of the mask material to assure themselves of wearing comfort.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for displaying a full head mask. The display package includes a frame with integral header for holding the mask. The mask is disposed between cooperating inner and outer shell members that maintain the face covering portion of the mask relatively sanitary. Preferably, each of the inner and outer shell members include a forwardly projecting area substantially conforming to the shape of a face for the realistic display of the mask.

The frame includes a front and rear panel. The front and rear panels may be hingedly connected together along a top edge of the header. The front panel includes a display opening for the receipt of the forwardly projecting area of the inner and outer shell members. The mask and the inner and outer shell members are disposed between the front and rear frame panels that are then fastened together to maintain the integrity of the display package. Advantageously, in this way the mask may be secured to the package without extending any fasteners through the mask and therefore potential damage to the mask is eliminated.

Preferably, the rear panel includes an access opening that exposes a back of the head portion of the mask, rather than the face covering portion, for examination and touching by the consumer. Thus, consumers are allowed to inspect the mask material to assure wearing comfort without opening or damaging the packages and without soiling or getting germs on the face covering portion. It should also be recognized that the access opening in combination with the forwardly projecting outer shell allows the nesting of the adjacent masks on a display rod as well as nesting during shipment.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIGS. 1–4 are perspective views showing the various steps in packaging a mask in accordance with the teachings of the present invention;

Reference will now be made in detail to the present preferred embodiment of the invention, an example of which is illustrated in the accompanying drawing.

DETAILED DESCRIPTION OF THE INVENTION

Figure 6:
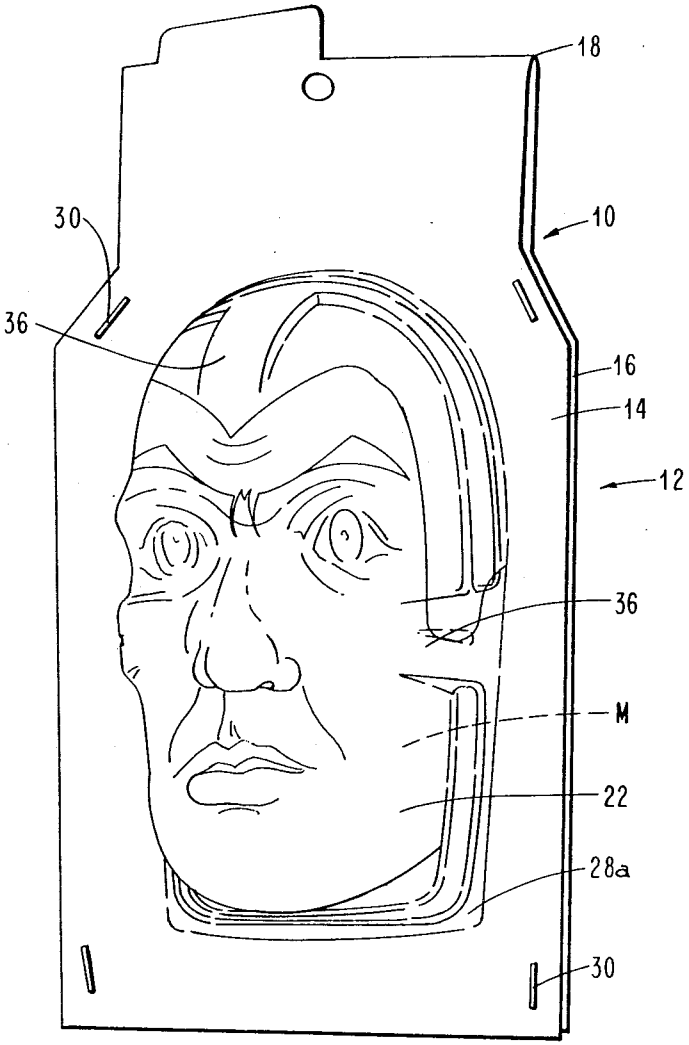
FIG. 6 is a front perspective view of the completed package of the present invention.

Reference is now made to FIG. 6 showing the full head mask display package 10 of the present invention. The package is being described with respect to a stretch stocking or ski-type mask M that is pulled completely over the head of the wearer. It should be recognized, however, that other types of masks, such as facial masks, may be packaged using the teachings and concepts of the present invention.

Figure 5:
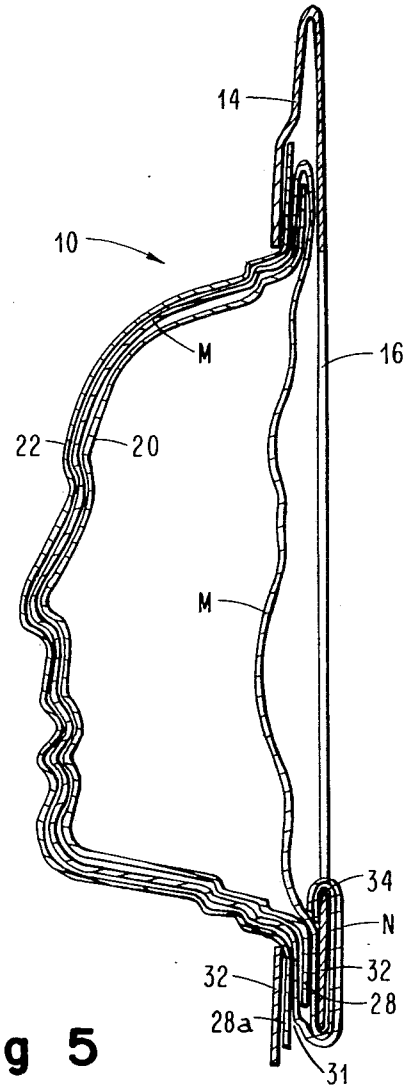
FIG. 5 is a cross-sectional view of the mask display package of the present invention.

The display package 10 includes a frame member 12 having a front panel 14 and a rear panel 16, as shown in FIG. 1. The front and rear panels 14, 16 are connected together along their upper edge by a hinge 18 to form a double thickness header (note FIG. 2). An inner shell member 20 is positioned within the mask M and against the face receiving portion. As should be appreciated, the inner shell member 20 includes a forwardly projecting area or surface substantially conforming to the shape of a face and, therefore, the shell provides realistic display of the mask. A cooperating outer shell member 22 (transparent for viewing the mask) nests with and overlies the inner shell member 20 and covers the front face portion of the mask M. Thus, as shown in FIGS. 3 and 5, the face portion of the mask M is disposed between the inner and outer shell members 20, 22 and, therefore, is protected from damage and soiling. More particularly, that portion of the mask that receives the eyes, nose and mouth is maintained relatively sanitary.

The mask M and inner and outer shell members 20, 22 are then inserted between the front and rear panels 14, 16 of the frame member 12. Particularly, the front panel 14 includes a display opening 24 for the receipt of the forwardly projecting area of the outer shell member 22 and face portion of the mask disposed directly behind. An access opening 26 is provided in the rear frame panel 16. The access opening 26 exposes a portion of the mask other than the face covering portion (i.e. that portion of the mask covering the back of the head) for inspection and actual touching by the consumer without causing contamination of any kind. This feature thus allows the purchaser to make an actual and safe determination of the wearing comfort of the mask material, and to do so without opening the package. It also allows nesting of the mask display packages 10 one within another for orderly display rod stocking at the point of sale.

Once the forwardly projecting area of the outer shell member 22 is received within the display opening 24 of the front frame panel 14, the frame member 12 is simply folded along the hinge 18 so that the front and rear panels 14, 16 are brought together (note FIGS. 2–4). Rims **28, 28*a* around the inner and outer shell members 20, 22 engage the marginal walls of the front and rear frame panels 14, 16 around the display and access openings 24, 26 to maintain the mask in position within the frame 12. The frame panels 14, 16 are then fastened together as, for example, by means of staples 30 (note FIG. 6) that maintain the integrity of the package 10. The staples pass through the rim 28*a* to strengthen the package and to minimize the possibility of unauthorized removal of the outer shell member 22 by simply squeezing and pulling the shell member outwardly allowing the rim 28*a* to snap through the opening 24, or taking out only one of the staples 30 at the bottom and slipping the shell member out of that corner. However, the rim 28 is not stapled so that the mask M can be easily removed when the package is opened by opening all of the staples 30. The entire package can be reassembled after each mask use to keep it sanitary, undamaged and unwrinkled ready for the next use. New staples or simply paper clips may be used to attach the frame panels 14, 16** securely together.

As should be appreciated from FIGS. 3 and 4, a stretch stocking mask M of the type shown may include an extended neck covering portion N. This portion N may extend through a passage 31 between the bottom flange sections 32 of the front and rear frame panels 14, 16. This neck covering portion N of the mask M may be manually pulled from the display package 10 for inspection by the purchaser. Preferably, this neck covering portion N is normally wrapped around and tucked behind the bottom flange 32 of the rear panel 16 (note FIG. 5) for an aesthetically pleasing package. A serration along the inner edge 34 of the bottom flange 32 serves to provide a number of individual points of concentrated pressure for maintaining the neck portion N in the tucked position.

In summary, numerous benefits have been described which result from employing the concepts of this invention. In particular, the cooperating shell members 20 and 22 maintain the face covering portion of the mask M relatively sanitary. The purchaser, however, is still allowed to inspect the mask material by touching an exposed portion of the mask, such as the back of the head or neck. The access opening 26 in the rear frame member 16 allows the inspection of the mask material on the back of the head, as well as nesting of the masks one within another for stacking during shipping and display purposes. The neck portion of the mask that extends downwardly from the display package 10 between the front and rear frame panels 14, 16 for inspection is normally wrapped around and tucked behind a bottom flange 32 of the rear frame panel 16 with holding serrated edge 34. The entire package is strong and durable because of the double frame panels 14, 16, double shell members 20, 22 and double header construction. Also the package can be easily reassembled for storage of the mask M after each use.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, both the inner and outer shell members 20, 22 that protect the face of the mask from damage and maintain the face covering portion of the mask relatively sanitary may include reinforcing ribs 36. These ribs strengthen the shell members 20, 22 and prevent collapse of the members during handling. The embodiment of FIGS. 1–6 was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A display package for a mask having a portion for covering the entire face of the wearer, a head covering portion attached thereto, and a neck portion extending downwardly from both the face and head covering portions, said display package comprising:

frame means for holding the mask;

means for maintaining the face covering portion of the mask sanitary comprising cooperating inner and outer shell members, substantially only said face covering portion of said mask being disposed between said inner and outer shell members; and means exposing a portion of the mask other than the face covering portion for examination and touching without opening the display package.

2. The mask display package set forth in claim 1, wherein said inner and outer shell members each include a forwardly projecting area substantially conforming to the shape of a face for realistic display of the mask.

3. The mask display package set forth in claim 2, wherein a rim portion is provided around said forwardly projecting area of each shell member, said rim portion serving to engage said frame means.

4. The mask display package set forth in claim 1, wherein said frame means includes a front panel and a rear panel.

5. The mask display package set forth in claim 4, wherein said front and rear panels each include a top edge, said panels being hingedly connected together along said top edges to form an integral header.

6. The mask display package set forth in claim 4, wherein said front panel includes a display opening for the receipt of the forwardly projecting area of said outer shell member.

7. The mask display package set forth in claim 6, wherein said mask and inner and outer shell members are disposed between said front and rear frame panels and means are provided for fastening said front and rear frame panels together and maintaining the integrity of the display package.

8. The mask display package set forth in claim 4, wherein said exposing means is an access opening in said rear frame panel allowing inspection of the portion of said mask other than said face covering portion.

9. The mask display package set forth in claim 8, wherein said rear frame panel includes a bottom flange and the neck portion of said mask is wrapped around and tucked behind said bottom flange through said access opening.

10. The mask display package set forth in claim 9, wherein said bottom flange includes a serrated edge for maintaining said neck portion of said mask in a tucked position.

11. The mask display package set forth in claim 1, wherein at least said inner shell member includes reinforcing rib means to strengthen said member.

12. The mask display package set forth in claim 1, wherein said outer shell is transparent for viewing the mask.

13. The mask display package set forth in claim 1, wherein said exposing means comprises a passage along a bottom portion of said frame means, the neck portion being extended through said passage to the outside of said display package.

14. The mask display package of claim 7, wherein said fastening means includes a rim portion provided around said forwardly projecting area of each shell member, said rim portion serving to engage said frame means.

15. The mask display package set forth in claim 14, wherein said fastening means includes staples extending through said front and rear frame panels, said staples passing through the rim portion of said outer shell member to prevent unauthorized removal but spaced from the rim portion of said inner shell member.

* * * * *